US006789344B2

(12) United States Patent
Cain

(10) Patent No.: US 6,789,344 B2
(45) Date of Patent: Sep. 14, 2004

(54) ARM REST AND SUPPORT FOR AIMING

(76) Inventor: Charles W. Cain, 22689 Leatherwood Rd., Quaker City, OH (US) 43773

( * ) Notice: Subject to any disclaimer, the term of this patent is extended or adjusted under 35 U.S.C. 154(b) by 0 days.

(21) Appl. No.: 10/636,926

(22) Filed: Aug. 7, 2003

(65) Prior Publication Data

US 2004/0031183 A1 Feb. 19, 2004

Related U.S. Application Data

(60) Provisional application No. 60/403,713, filed on Aug. 15, 2002.

(51) Int. Cl.[7] ..... F41C 27/30

(52) U.S. Cl. ..... 42/94; 42/106; 224/270; 224/265; 352/243

(58) Field of Search ..... 42/94, 106; 224/270, 224/365; 352/243

(56) References Cited

U.S. PATENT DOCUMENTS

| | | | | | |
|---|---|---|---|---|---|
| 281,338 | A | * | 7/1883 | Butler | 42/94 |
| 664,979 | A | * | 1/1901 | Taylor | 42/94 |
| 784,390 | A | * | 3/1905 | Dunham | 42/94 |
| 798,734 | A | * | 9/1905 | King | 42/94 |
| 805,189 | A | * | 11/1905 | Dubert | 42/94 |
| 898,658 | A | * | 9/1908 | Burnaugh | 418/129 |
| 915,481 | A | * | 3/1909 | Roop | 42/94 |
| 1,288,684 | A | * | 12/1918 | Roe | 42/94 |
| 3,022,898 | A | * | 2/1962 | Loeb | 211/64 |
| 3,963,156 | A | * | 6/1976 | Perrin | 224/268 |
| 4,207,699 | A | * | 6/1980 | Hensley | 42/94 |
| 4,394,075 | A | * | 7/1983 | Brown et al. | 352/243 |
| RE32,213 | E | * | 7/1986 | Brown | 352/243 |
| 4,844,390 | A | * | 7/1989 | Duke | 248/118 |
| 5,111,983 | A | * | 5/1992 | Simmons et al. | 224/258 |
| 5,351,867 | A | * | 10/1994 | Vest | 224/661 |
| 5,421,115 | A | * | 6/1995 | McKay | 42/94 |
| 5,522,573 | A | * | 6/1996 | Xiao | 248/118 |
| 5,669,170 | A | * | 9/1997 | Norris | 42/85 |
| 5,740,625 | A | | 4/1998 | Jenkins | 42/94 |
| 5,784,820 | A | | 7/1998 | Wood | 42/94 |
| 5,806,734 | A | * | 9/1998 | Scott | 224/265 |
| 5,819,461 | A | * | 10/1998 | Killian | 42/94 |
| 5,829,652 | A | * | 11/1998 | Denzer et al. | 224/270 |
| 6,009,655 | A | | 1/2000 | Austin | 42/94 |
| 6,082,034 | A | * | 7/2000 | Musmanno | 42/94 |
| 6,336,576 | B1 | * | 1/2002 | Easter | 224/153 |

OTHER PUBLICATIONS

"Advice for daughter going to war", Parade Magazine, Jun. 13, 1993, pp12.*

* cited by examiner

*Primary Examiner*—Michael J. Carone
*Assistant Examiner*—John Richardson
(74) *Attorney, Agent, or Firm*—Eley Law Firm Co.; James R. Eley; Michael A. Forhan

(57) ABSTRACT

An arm rest and support for aiming. The arm rest and support consists of an upper member hingedly attached to a lower member. A pair of straps attached to the lower member wrap around the torso of the user for support. A third strap attached to the upper member is adapted to wrap around the aiming arm of the user. When not in use, the arm rest and support may be folded, allowing the user to move about. When the support is needed, the user simply raises his or her arm, causing the upper member to pivot and lock at an approximate right angle in relation to the lower member, providing the user with support for aiming resulting in greater accuracy and reduced fatigue.

15 Claims, 4 Drawing Sheets

ARM REST AND SUPPORT FOR AIMING

This application claims the benefit of U.S. Provisional Patent Application 60/403,713, filed Aug. 15, 2002.

FIELD OF THE INVENTION

This invention relates to an arm rest and support. Specifically, the invention relates to a mobile arm rest and support to improve aiming accuracy of weapons and other hand-held devices, such as cameras, telescopes, binoculars and video equipment.

BACKGROUND OF THE INVENTION

Improving the accuracy of weapons is a constant goal of designers and manufacturers. Many sighting aids, including magnifying scopes and even laser sights have been developed to this end. However, the weapon user's eye-hand coordination, muscle tension, the weight of the weapon, and even breathing can all contribute to aiming variations that cannot be overcome with sighting aids. It is well-known that accuracy in aiming weapons may be improved by providing a means of solidly supporting the weapon. A support will hold the weight of the weapon steadily for a nearly indefinite period of time. A typical example is a hunter's use of a tree fork to steady the aim of a rifle.

A wide variety of portable supports have been developed to increase aiming accuracy. For instance, uni-pod, bi-pod and tri-pod supports which attach directly between the weapon and a support structure, such as the ground, are common in the art. An example of this type of support may be found in U.S. Pat. No. 5,740,625, issued to Jenkins. However, the stationary nature of these devices limit the user's mobility. These devices are also cumbersome to carry and take time to set up, making them impractical for hunting use other than in a fixed location such as a deer stand.

When hunting, it is frequently necessary to walk significant distances while tracking game. This creates a need for an aiming support that is highly mobile. The prior art has attempted to solve this problem with portable aiming supports, such as U.S. Pat. No. 5,784,820, issued to Wood. However, such devices limit the user's mobility if worn while moving about, particularly in rough terrain or heavily wooded areas. Arm stabilizers in the prior art, such as U.S. Pat. No. 6,009,655, issued to Austin, attempt to solve the problem of mobility by providing a support that folds into a stowed position. However, such devices must be moved from the stowed position to an in-use position before the support can be employed, consuming valuable time. In particular, an aiming support used as a hunting aid must be capable of very quick and consistent deployment, since the hunter often has only a brief instant of time to aim his weapon and fire while the quarry is still within range. There is a need for an aiming support that is highly portable, does not limit the user's mobility, and can be quickly deployed.

SUMMARY OF THE INVENTION

An arm rest and support for aiming is disclosed. The support consists of a padded upper member hingedly attached to a lower member. A pair of straps attached to the lower member are configured to wrap around the torso and/or shoulder of the user for support. A third strap attached to the upper member is adapted to wrap around the aiming arm of the user. When not in use, the arm rest and support may be folded, allowing the user to move about. When the arm rest and support is needed, the user simply raises his/her arm, causing a locking brace to lock the upper member at an approximate right angle in relation to the lower member, providing the user with support for aiming weapons or other hand-held devices with greater accuracy and reduced fatigue.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENT(S)

Figure 1:
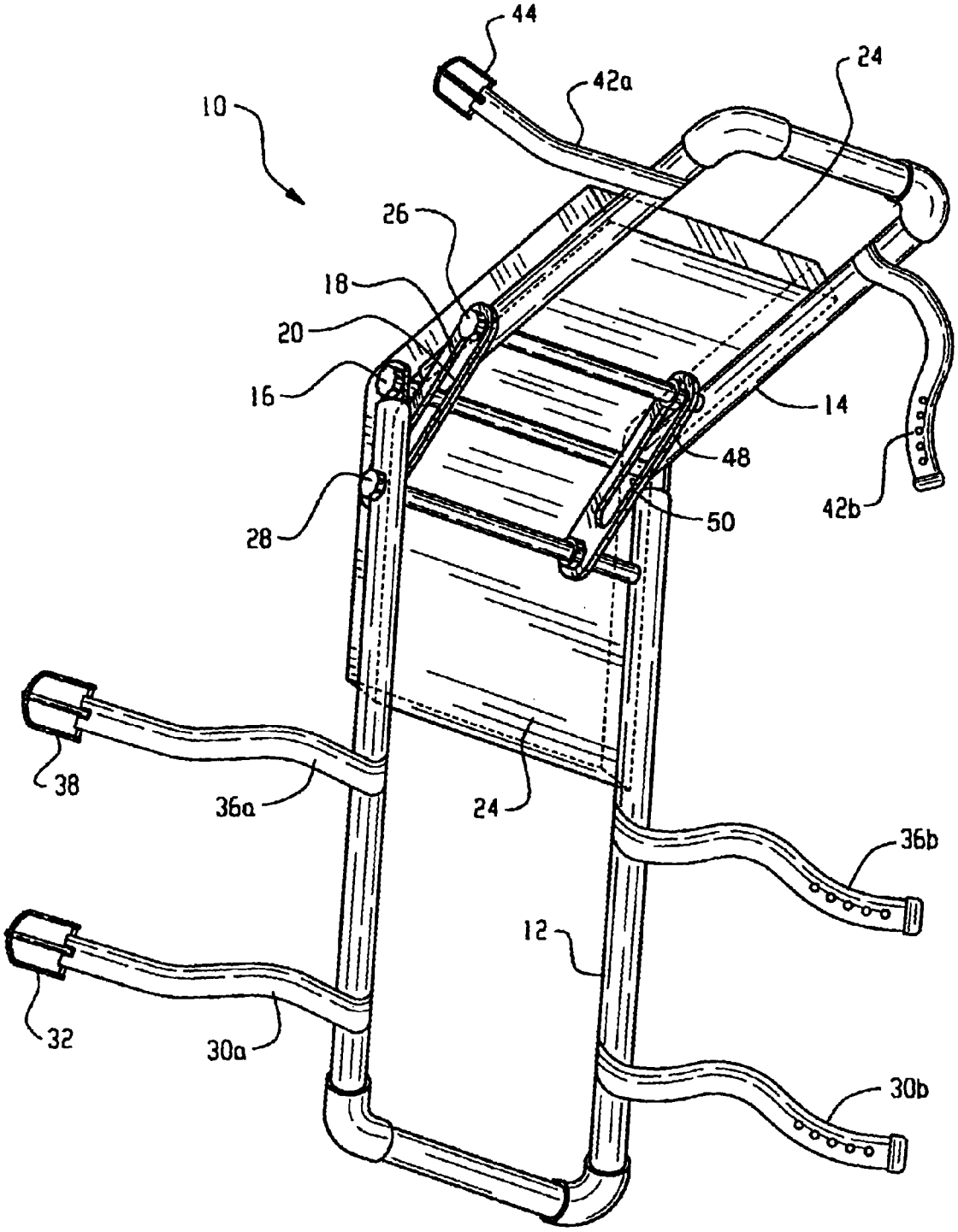
FIG. 1 is a perspective view of a left-hand embodiment of the arm rest and support invention in an extended position.
Figure 2:
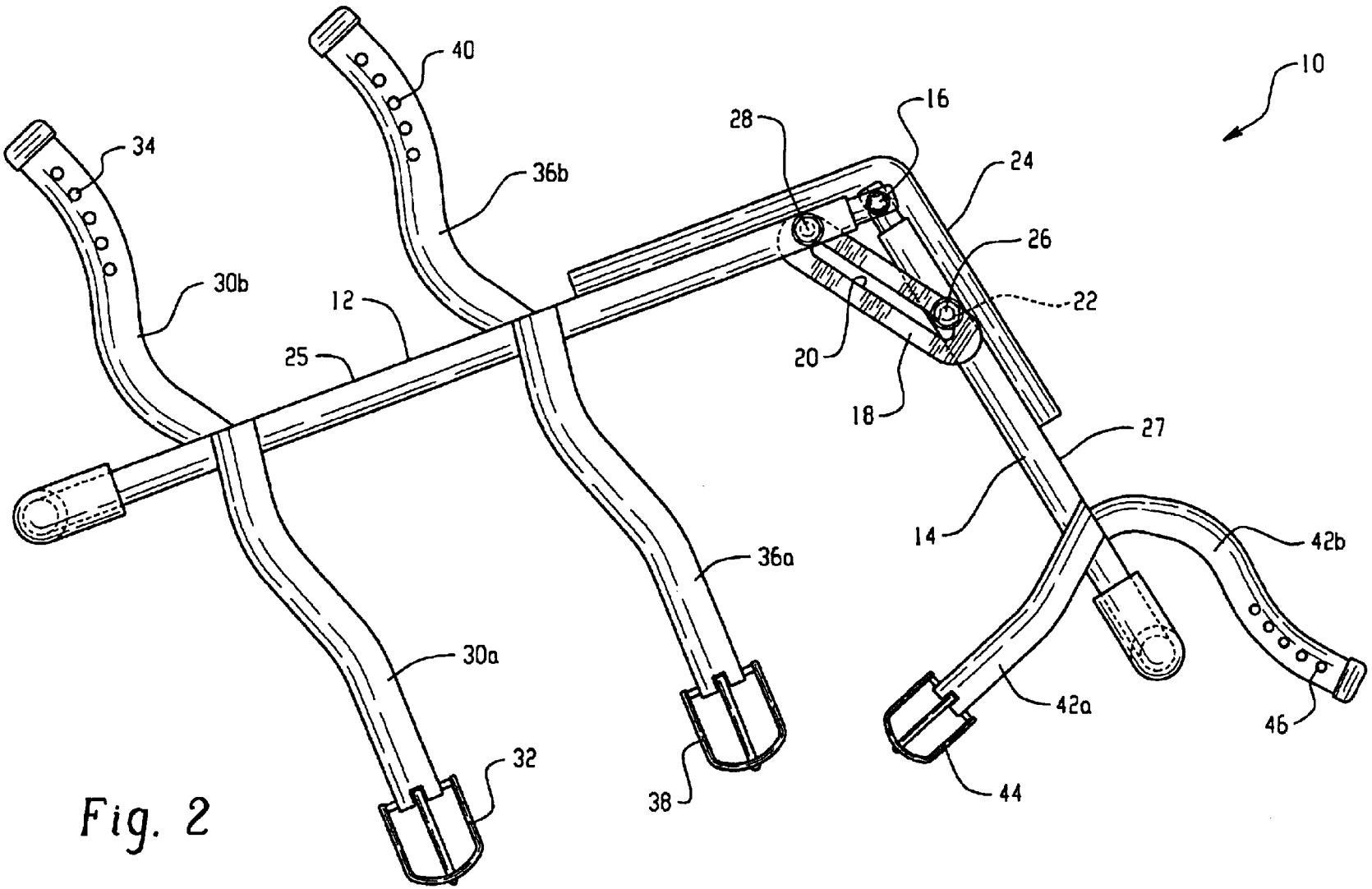
FIG. 2 is a side view of the arm rest and support of FIG. 1 in an extended position.
Figure 3:
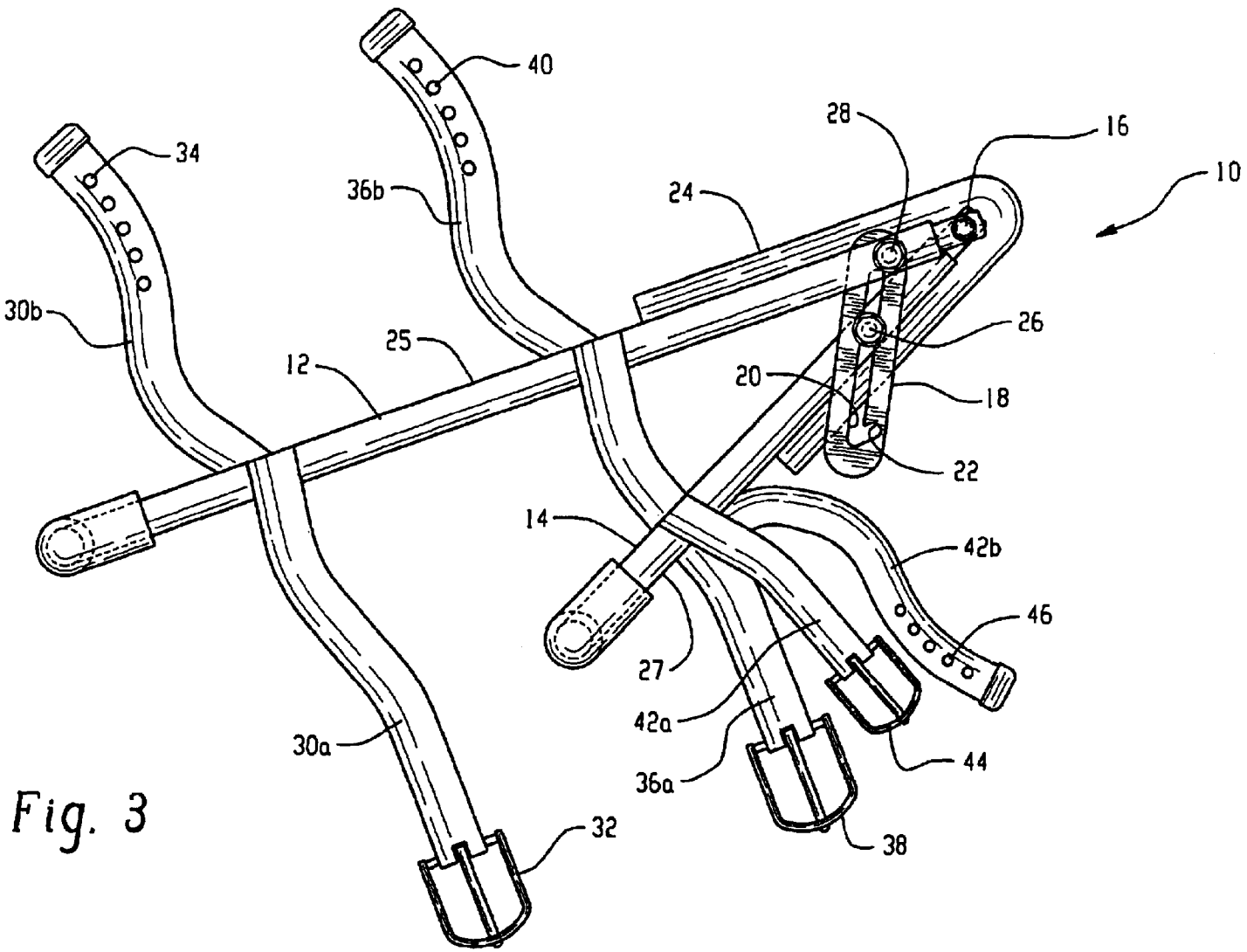
FIG. 3 is a side view of the arm rest and support of FIG. 1 in a folded position.

An arm rest and support 10 according to the present invention is illustrated in FIGS. 1, 2 and 3. A lower member 12 is hingedly attached to an upper member 14 by a first pivot 16, such as a pin or hinge. The lower and upper members 12, 14 may be generally planar and rectangularly-shaped, or may be any other shape convenient for contact with the user's torso and arm. Example shapes include, but are not limited to, rounded rectangles, tubular, and relatively thin plates. The lower and upper members 12, 14 may be constructed from any suitable, relatively lightweight yet structurally sound materials. Examples include, but are not limited to, metals such as steel and aluminum, composites and plastics. Further, the lower and upper members 12, 14 may be finished in any manner suitable for the materials selected, such as anodizing, iriditing, plating and paint. Lastly, the lower and upper members 12, 14 may be any desirable color or pattern, such as camouflage or solid, dark and non-reflective colors.

A locking brace 18 is attached between the lower and upper members 12, 14 by a second pivot 28 and a locking pin 26. The locking brace 18 includes a first slot 20 and a cavity 22. The locking pin 26 is captively placed into the first slot 20 such that the locking pin moves slidably along the first slot 20 as the lower and upper members 12, 14 are pivoted. When the lower and upper members 12, 14 are at an approximate right angle to each other, at preferably about a 90° angle, the locking pin 26 moves into cavity 22 to lock the lower and upper members into a fixed position. A single cavity 22 is preferred over a plurality of cavities. Although a plurality of cavities 22 would provide multiple locking positions for the arm rest and support 10, it is felt that the additional cavities would delay the time required to deploy the arm rest and support, detracting from the utility of the arm rest and support.

A support brace 48 is positioned generally parallel to the locking brace 18 and spaced apart from the locking brace, as is best seen in FIG. 1. The support brace 48 is attached between the lower and upper members 12, 14 by the second pivot 28 and the locking pin 26. The support brace 48 includes a second slot 50, but does not have a cavity. The locking pin 26 moves slidably along the second slot 50 of the support brace 48 as the lower and upper members 12, 14 are pivoted. The motion of the support brace 48 is generally similar to the motion of the locking brace 18, except that the support brace does not have a means for locking the lower and upper members 12, 14 into a fixed position.

A pad 24 may be flexibly attached to the outer portions 25, 27 of lower and upper members 12, 14 for the comfort of the user. The pad 24 may be fabricated from any conventional materials, such as compressible foam, rubber and sealed gel padding. The pad 24 may optionally have a protective covering material to protect the pad from the elements and prevent excessive wear. Example protective covering materials may include plastic and leather. The protective covering material may optionally have a desirable color or pattern, such as camouflage. Further, the pad 24 may be permanently affixed to the arm rest and support 10, or made removable to facilitate cleaning or replacement. In an optional embodiment of the present invention, two separate pads 24 may be attached to the lower and upper members 12, 14 respectively, one pad being attached to each member.

With further reference to FIGS. 1, 2 and 3, the arm rest and support 10 is extended for use by pivoting the upper member 14 away from the lower member 12. As the upper member 14 rotates about the first pivot 16, the locking pin 26 travels along the first slot 20 of the locking brace 18 as the locking brace rotates about the second pivot 28; likewise, the locking pin 26 also travels along the second slot 50 of the support brace 48 as the support brace pivots about the second pivot 28. When the lower and upper members 12, 14 are at an approximate right angle to each other, the locking pin 26 moves into the cavity 22, securing the locking brace 18 and holding the upper member 14 rigidly in place.

The arm rest and support 10 may be constructed to be used in connection with either the right or left arm, depending on the locations of the locking brace 18 and the support brace 48. The locking brace 18 is preferably located proximate the torso of the user, with the support brace 48 being located parallel to the locking brace and spaced apart from the torso of the user. This arrangement allows the user to easily use the unsupported arm and hand to access the locking brace 18 and push the locking pin 26 out of the cavity 22 when the user desires to fold the arm rest and support 10. FIGS. 1–3 show a configuration of the arm rest and support 10 adapted for use with a left arm and hand, while FIG. 4 shows an arm rest and support adapted for use with a right arm and hand.

Figure 4:
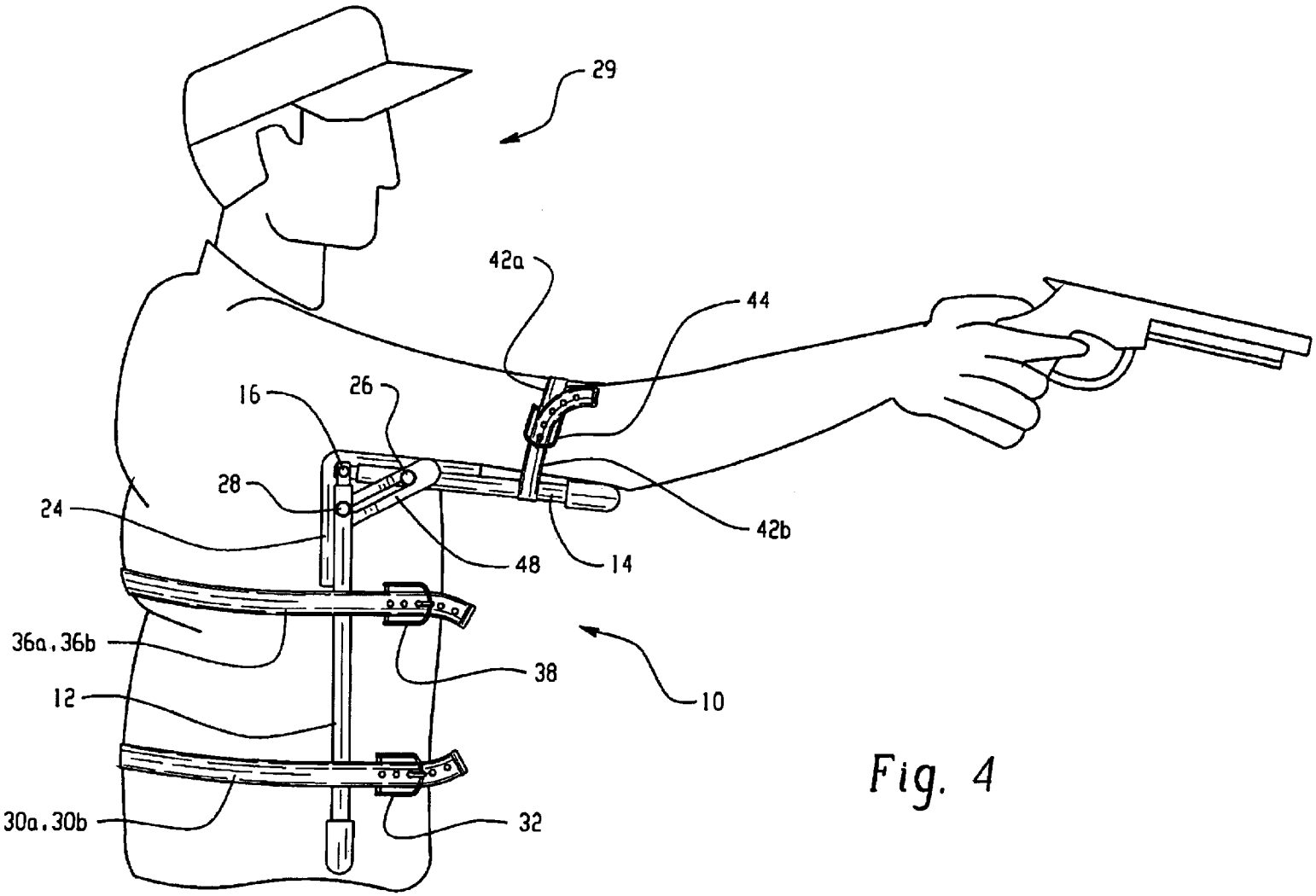
FIG. 4 is a view of a right-hand embodiment of the arm rest and support invention in operation.

With reference to FIG. 4 and with continuing reference to FIGS. 1–3, the arm rest and support 10 is installed by a user 29 without aid from others by placing the lower member 12 against the user's torso and placing the pad 24 under the user's arm with the upper member 14 generally parallel with the user's arm. A lower torso strap 30*a*–*b* is then wrapped around the user's lower torso and adjusted for a snug fit. The strap 30*a*–*b* is coupled together with at least one fastener, such as a buckle 32 and strap adjustment holes 34. An upper torso strap 36*a*–*b* is similarly installed around the user's upper torso and coupled together with at least one fastener, such as a buckle 38 and adjustment holes 40. An arm strap 42*a*–*b* is then installed around the user's arm and coupled together with at least one fastener, such as a buckle 44 and adjustment holes 46. The straps 30, 36, 42 may be fabricated from a wide range of materials, including but not limited to, leather, webbing, cloth and synthetic materials. The straps 30, 36, 42 may be attached to the lower and upper members 12, 14 by any conventional means, such as rivets, screws, adhesives, fasteners, sewing, bonding and molding.

The arm rest and support 10 may also be installed by a user 29 by means of an alternate process, also without aid from others. The user 29 first loosely couples together the arm strap 42*a*–*b*, then slides the hand of the arm to be supported over the upper member 14, beginning generally at the pivot 16 of lower and upper members 12, 14 and proceeding along the outer portion 27 through the arm strap. The user 29 then moves the support 10 upwardly along the user's 29 arm until the arm strap 42*a*–*b* is positioned generally above the elbow. The user 29 then applies a light arm pressure against the arm rest and support 10, capturing the support between the arm and torso such that the upper member 14 is positioned generally adjacent to the user's arm, the lower member 12 is positioned generally adjacent to the torso, and the pivot 16 is generally in the user's armpit area. While continuing to hold arm pressure, the user 29 then securely couples the upper torso straps 36*a*–*b* over the opposite shoulder of the arm to be supported. The lower torso strap 30*a*–*b* is then secured at approximately the user's belt line. Lastly, the arm strap 42*a*–*b* is adjusted for a slightly loose fit.

In operation, the arm rest and support 10 is kept in a folded position as shown in FIG. 3, allowing the user's 29 arm freedom of movement. When the user 29 desires aiming support, the user simply raises his/her arm to an aiming position, causing the upper member 14 to be locked in a first position at approximately a right angle (i.e., generally perpendicular) to the lower member 12 by the locking brace 18, cavity 22, and locking pin 26, providing support for aiming a weapon, camera, or the like. When the support 10 is no longer needed, the locking pin 26 is pushed out of the cavity 22 and into the first slot 20 of the locking brace 18 by the user 29. The user 29 then lowers his arm, causing the locking pin 26 to travel along the first and second slots 20, 50 as the upper member 14 moves toward lower member 12, to a folded position such that the upper member is in a second position at an acute angle to the lower member under the user's arm until called back into service.

It can be readily seen that the present invention provides a number of advantages. Firstly, the arm rest and support 10 provides the user 29 with a steady and comfortable support, allowing the user to improve his aim. In addition, the arm rest and support 10 may be rapidly deployed by the user 29 for use without any set-up delay, by simply raising the supported arm to a firing position. Further, the relatively compact size and light weight of the arm rest and support 10 allows the arm rest and support be used under any loose-fitting hunting clothes and in nearly any type of weather conditions.

From the above description of the invention, those skilled in the art will perceive improvements, changes, and modifications in the invention. Such improvements, changes, and modifications within the skill of the art are intended to be covered.

What is claimed is:

1. An arm rest and support for aiming, comprising:

a) a lower member;

b) an upper member pivotally attached to the lower member, the upper member being pivotable between a first and second position;

c) a locking pin attached to the upper member;

d) at least one locking brace comprising a first slot and a cavity, a first portion of the locking brace being pivotally attached to the lower member and a second portion being slidably attached to the upper member by the locking pin, first slot and cavity, such that the locking pin is:

i) operable with the cavity to lock the upper member in a predetermined first position generally perpendicular to the lower member, and ii) operable with the first slot to pivot the upper member to a second position at a generally acute angle to the lower member;

e) at least one support brace comprising a second slot, a first portion of the support brace being pivotally attached to the lower member and a second portion being slidably attached to the upper member by the locking pin in cooperation with the second slot;

f) at least one arm strap, the arm strap having at least one fastener and being attached to the upper member;

g) at least one torso strap, the torso strap having at least one fastener and being attached to the lower member; and h) a pad attached to an outer portion of the lower member and an outer portion of the upper member.

2. The arm rest and support of claim 1 wherein the torso strap comprises an upper torso strap and a lower torso strap.

3. The arm rest and support of claim 1 wherein the pad comprises two separate portions, a first portion being attached to the upper member and a second portion being attached to the lower member.

4. The arm rest and support of claim 1 wherein the pad further comprises a protective covering material.

5. The arm rest and support of claim 1 wherein the pad is removable.

6. The arm rest and support of claim 1 wherein the arm strap and torso strap fasteners are buckles and adjustment holes.

7. The arm rest and support of claim 1 wherein the arm strap and torso strap are comprised of leather.

8. The arm rest and support of claim 1 wherein the arm strap and torso straps are comprised of webbing.

9. The arm rest and support of claim 1 wherein the upper and lower members are made of metal.

10. The arm rest and support of claim 9 wherein the upper and lower members further comprise a finish.

11. The arm rest and support of claim 1 wherein the upper and lower members are made of plastic.

12. The arm rest and support of claim 1 wherein the upper and lower members are made of composites.

13. The arm rest and support of claim 1, wherein the surface of the arm rest and support comprises a color or a pattern.

14. The arm rest and support of claim 13 wherein the arm rest and support has a camouflage pattern.

15. An arm rest and support for aiming, comprising:

a) a metal lower member;

b) a metal upper member pivotally attached to the lower member, the upper member being pivotable between a first and second position;

c) a locking pin attached to the upper member;

d) at least one locking brace comprising a first slot and a cavity, a first portion of the locking brace being pivotally attached to the lower member and a second portion being slidably attached to the upper member by the locking pin, first slot and cavity, such that the locking pin is:

i) operable with the cavity to lock the upper member in a predetermined first position generally perpendicular to the lower member, and ii) operable with the first slot to pivot the upper member to a second position at a generally acute angle to the lower member;

e) at least one support brace comprising a second slot, a first portion of the support brace being pivotally attached to the lower member and a second portion being slidably attached to the upper member by the locking pin in cooperation with the second slot;

f) an arm strap, the arm strap having at least one fastener and being attached to the upper member;

g) an upper torso strap, the upper torso strap having at least one fastener and being attached to an upper portion of the lower member;

h) a lower torso strap, the lower torso strap having at least one fastener and being attached to a lower portion of the lower member, and i) a removable pad attached to an outer portion of the lower member and an outer portion of the upper member, the pad having a protective covering.

* * * * *